US012000281B2

(12) United States Patent
Buckley et al.

(10) Patent No.: US 12,000,281 B2
(45) Date of Patent: Jun. 4, 2024

(54) HORIZONTAL DIRECTIONAL DRILLING SYSTEM WITH IMPROVED SYSTEM FOR LIMITING TORQUE

(71) Applicant: Vermeer Manufacturing Company, Pella, IA (US)

(72) Inventors: Zach Buckley, Ankeny, IA (US); Jason Morgan, Pleasantville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 78 days.

(21) Appl. No.: 17/946,123

(22) Filed: Sep. 16, 2022

(65) Prior Publication Data

US 2023/0084077 A1 Mar. 16, 2023

Related U.S. Application Data

(60) Provisional application No. 63/244,942, filed on Sep. 16, 2021.

(51) Int. Cl.
*E21B 7/04* (2006.01)
*E21B 15/04* (2006.01)
(Continued)

(52) U.S. Cl.
CPC ..... *E21B 7/046* (2013.01); *E21B 15/04* (2013.01); *E21B 19/166* (2013.01); *E21B 44/04* (2013.01)

(58) Field of Classification Search
CPC ..... E21B 7/046; E21B 15/04; E21B 19/166; E21B 44/04
See application file for complete search history.

(56) References Cited

U.S. PATENT DOCUMENTS 4,305,472 A * 12/1981 Brossette ..... E21B 19/166 173/180
6,357,537 B1 * 3/2002 Runquist ..... E21B 7/04 175/62

(Continued)

FOREIGN PATENT DOCUMENTS

| | | | |
|---|---|---|---|
| CN | 203770258 | U | 8/2014 |
| EP | 2987948 | A1 | 2/2016 |
| WO | 0169035 | A1 | 9/2001 |

OTHER PUBLICATIONS

GPM Hydraulic Consulting, Inc., You Tube Video: https://www.youtube.com/watch?v=rRFHJ-2HA28, Setting Crossport Relief Valves, May 6, 2014, 6 screenshots.

(Continued)

*Primary Examiner* — Jonathan Malikasim
(74) *Attorney, Agent, or Firm* — Michael Best & Friedrich LLP

(57) ABSTRACT

A method of controlling a horizontal directional drill having a rotary drive system. The rotary drive system includes a variable displacement pump providing pressurized fluid to a motor, a displacement control that adjusts motor displacement, a torque limiter valve that opens at a torque limit to provide pressurized fluid to the displacement control to allow the system to limit torque, and cross-port relief valves that open at a cross-port relief pressure to limit pressure applied across a motor inlet and a motor outlet. The method includes adjusting the torque limiter pressure to vary the maximum torque applied to a drill string based on operating parameters of the horizontal direction drill, and adjusting the cross-port relief pressure to be higher than the torque limiter pressure each time that the torque limiter pressure is adjusted.

19 Claims, 9 Drawing Sheets

(51) Int. Cl.
*E21B 19/16* (2006.01)
*E21B 44/04* (2006.01)

(56) References Cited

U.S. PATENT DOCUMENTS

| | | | | |
|---|---|---|---|---|
| 6,491,115 | B2 * | 12/2002 | Van Houwelingen .. | E21B 19/08 175/57 |
| 7,350,593 | B1 * | 4/2008 | Brookover ..... | E21B 44/02 173/4 |
| 9,719,314 | B2 * | 8/2017 | Lane ..... | E21B 3/022 |
| 11,525,321 | B2 * | 12/2022 | Matheus Valero ..... | E21B 44/06 |
| 2020/0392798 | A1 | 12/2020 | Cutler et al. | |

OTHER PUBLICATIONS

Danfoss, Applications Manual: Pressure and Speed Limits for Hydrostatic Units, May 2015, 24 Pages.
Sun Hydraulics, Model RVIA, Ventable, pilot-operated, balanced piston relief valve, technical data sheets, 2019, 2 Pages.
Hydraulics & Pneumatics, Technologies—Manifolds & Hics, Valves Add Function to Form, by Darren Magner—Sauer—Danfoss, Ames, Mar. 25, 2008, 8 Pages.
International Search Report and Written Opinion for Application No. PCT/US2022/043737 dated Nov. 29, 2022 (15 pages).

* cited by examiner

HORIZONTAL DIRECTIONAL DRILLING SYSTEM WITH IMPROVED SYSTEM FOR LIMITING TORQUE

RELATED APPLICATIONS

This application claims the benefit of U.S. Provisional Application No. 63/244,942 filed Sep. 16, 2021, the entire content of which is hereby incorporated by reference herein.

BACKGROUND

The present invention relates to a horizontal directional drilling (HDD) machine that includes a rotational drive unit having a drive spindle configured to couple to a drill string, to rotate the drill string. The rotational drive unit is mounted on a carriage that can be propelled along the longitudinal axis of the drill string to move the drill string in (1) a forward direction, pushing the drill string, for extending a bore hole in a direction away from the HDD machine, or (2) in a backward direction, pulling the drill string, for extending a bore hole in a direction towards the HDD machine. The boring process is typically performed with the drill string being rotated while at the same time being propelled in either the forward or the rearward direction.

HDD machines are configured for use with a range of boring tools that vary significantly in diameter. A relatively small boring tool, typically called a drill bit, is used in an initial boring process to form a pilot hole. These drill bits have a leading asymmetrical feature, are attached to the front of the drill string, and the path of the bore hole is controlled by intermittently:

1) Pushing the drill bit forward while at the same time rotating the drill string and drill bit, which results in a bore path extending along the axis of the drill string, and
2) Pushing the drill bit forward without rotating the drill string and drill bit, which results in the bore path deviating from the axis of the drill string.

The bore path is typically controlled to exit into a trench, or to an exit at the ground surface at a desired exit point, where the drill bit is removed.

A larger boring tool, typically called a back reamer, is then connected to the end of the drill string and a subsequent boring process to enlarge the bore hole involves pulling the drill string and back reamer back towards the HDD machine. There is a significant variation in the size and configuration of back reamers. Each of the back reamers can have unique operating characteristics. The efficacy of the boring process will be affected by how the drill string and back reamer are rotated. The HDD machine is configured to control the speed and maximum torque applied.

As a result of this variation in boring tools, an HDD machine has the capability to allow operators to control the speed of rotation of the drill string, and to control a maximum torque applied to the drill string and the boring tool during the process of creating a bore hole. The rotational drive system of the HDD machine is configured to provide this capability, typically including a controller that provides a control signal to a hydraulic pump that provides hydraulic fluid to a hydraulic motor that powers the rotary motion of the drill string. In a common embodiment, the controller provides an electrical current to the pump, which is configured to generate a flow of hydraulic fluid that is proportional to the control current.

In addition to controlling the rotation of the drill string during the boring process, the rotational drive system is used to add individual drill rods to the drill string in a make-up process, and to remove individual drill rods from the drill string in a break-out process. In the make-up process the rotational drive system is used to apply a specific make-up torque to ensure that the drill rod being added to the drill string is properly connected. In the break-out process the rotational drive unit is used to apply a break-out torque in the opposite direction to separate a drill rod from the drill string. During the break-out process the rotational drive system may need to be capable of applying maximum torque to ensure that the drill rod can be separated from the drill string.

Many HDD machines utilize a hydrostatic transmission for the rotational drive, with a variable displacement hydraulic pump or a plurality of pumps that provide flow of a hydraulic oil to a hydraulic motor system. Hydrostatic transmissions are known to have the capability to control torque generated by the hydraulic motor by incorporating a pressure limiter. The pressure limiter reacts to the pressure generated by the pump, to de-stroke the pump(s), to reduce the displacement of the pump(s) when the pressure reaches a predefined pressure limit. In a hydrostatic transmission, a pressure limiter of the hydraulic pump will control the torque generated by the hydraulic motor, allowing control of the torque. The torque control described in the previous scenarios for the boring process and for the make-up and break-out processes will be labelled or referred to as a proactive control of the torque in this disclosure. In some instances, the proactive control is provided by a torque limiter system for a HDD machine with a rotational drive system having a hydrostatic system that has a pressure limiter for the hydraulic pump.

Alternatively, the proactive control may include a system having a pressure sensor configured to detect pressure at the hydraulic motor to provide feedback data to a closed-loop control algorithm that controls the electrical current to the pump. The control algorithm can reference a defined maximum pressure, that is proportional to a desired maximum torque, and if the measured pressure exceeds that defined maximum pressure, then the controller can reduce the current provided to the pump, effectively de-stroking the pump, to control this maximum pressure. This is an alternative system for providing proactive control of the torque.

The rotational drive system is also required to provide a reactive control of the torque. The reactive control is required to provide adequate dynamic response capability of the torque control system of the rotational drive unit. The proactive control allows the system to control the maximum torque in situations during normal operation, during which there are no abrupt changes in the torque. Reactive control is required in situations where there is an abrupt change in the torque. This occurs, for instance, during the boring process when the boring tool encounters a sudden change in the ground conditions. The boring tool can, for instance, get jammed on a rock causing it to stop suddenly. In this situation the torque will rise very quickly, and the systems used to provide the proactive torque control, by de-stroking the pump, do not respond quickly enough to provide adequate reactive control.

Hydrostatic systems are known to include different types of control systems for controlling torque generated by the motor. It is known to have one control that is capable of de-stroking the pump to control the pressure generated by the pump, to provide a proactive control, while in the same system providing a separate control to provide the reactive control. For instance a cross-port relief valve is known to provide this reactive control.

HDD machines are known to have either pressure limiters or pressure-based control algorithms that control the hydrostatic pump(s) for the proactive control, and cross-port reliefs that limit the pressure differential applied across the hydraulic motor(s) of the hydrostatic drive for the rotational drive unit for the reactive control. Known systems include a cross-port relief having an adjustable maximum pressure, where this maximum pressure is set to a specific maximum pressure independent of the pressure limiter or the pressure-based control algorithm.

HDD machines are known to provide different operating modes of the rotational drive unit, to provide adequate range of operating characteristics, as required by the various modes of operation, and for the various types of boring tools. For example, HDD machines are known to provide a high-speed mode, a medium-speed mode and low-speed mode, where the maximum speed of rotation of the rotational drive unit varies. Some HDD machines provide five different speed modes.

With these known systems on HDD machines, operators have been observed to operate in a rotational drive unit mode that requires relatively high system pressure, where the pressure setting to achieve the desired proactive control of torque is relatively high. The operators are making this decision, rather than operating in a mode where the system pressure can be lower, in order to avoid significant increases in operating pressure that result from variations in operating conditions, where the pressure in the hydraulic system will reach the limit set by the reactive control element, for instance the cross-port reliefs, without a significant increase from the expected system pressure. This is illustrated in prior art FIG. 4 and FIG. 5. FIG. 4 illustrates the expected system performance when the rotational drive unit is operated in a mode where the Torque Limiter setting can be relatively low. When a high torque event occurs, the system pressure increases to the cross-port relief valve setting, the reactive control, which is significantly above the pressure set by the torque limit, the proactive control, for a period of time until the torque limiting system can react. FIG. 5 illustrates the expected system performance when the rotational drive unit is operated in a mode where the Torque Limiter setting will be higher, relatively closer to the cross-port relief setting. When a high torque event occurs, the system pressure increases to the cross-port relief valve setting, which is in this case a smaller increase from the pressure set by the torque limit. The unintended increase in torque is less. The operators have been observed operating in a mode represented by FIG. 5 rather than a mode represented by FIG. 4, in order to reduce the unintended torque rise.

The desired maximum torque for the system changes frequently during the various phases of operation of a HDD machine, making it impossible/impractical with prior art systems to adjust the cross-port relief valves each time that the torque limit (pressure limit) changes. In addition, with the configuration of a HDD machine, the pump's pressure limiting system, that is used for setting a torque limit as the proactive control parameter, is located at the pump, which is typically in an engine enclosure, while the cross-port relief valves are located adjacent to the hydraulic motors of the rotational drive unit located on the carriage, spaced from the engine enclosure. This physical separation adds to the complexity of making adjustments to the cross-port relief valve.

The impact of operating hydrostatic systems at higher system pressures is known to result in lower system efficiency and reduced system life. Thus, there is a need for an improved system and method for coordinating the control of torque provided for proactive control and for reactive control.

SUMMARY

In one aspect, the disclosure provides a method of controlling a horizontal directional drill having a rotary drive system for applying torque to a drill string. The rotary drive system includes a variable displacement pump providing pressurized fluid to a motor that generates the torque, a displacement control that adjusts motor displacement to limit flow to maintain a controlled pressure, a torque limiter valve that opens at a torque limit pressure to provide pressurized fluid to the displacement control to allow the system to limit torque when a system pressure is equal to a pressure that will generate a desired maximum torque, and cross-port relief valves that open at a cross-port relief pressure to limit pressure applied across a motor inlet and a motor outlet. The method includes adjusting the torque limiter pressure to set the maximum torque applied to the drill string based on operating parameters of the horizontal direction drill, and adjusting the cross-port relief pressure to be higher than the torque limiter pressure each time that the torque limiter pressure is adjusted.

In another aspect, the disclosure provides a drilling machine having a rotary drive for applying torque to a drill string and a system for controlling the torque. The system includes a controller having an operator input that allows an operator to specify an operating torque limit, a variable displacement hydraulic pump that provides hydraulic fluid to a motor at a variable flow rate, and a torque limiter valve that provides hydraulic fluid to de-stroke the pump when a pressure of the hydraulic fluid provided to the motor is equal to a first predetermined set point. The first predetermined set point is adjustable. The system further includes a cross-port relief that allows hydraulic fluid to bypass the motor when a pressure of the hydraulic fluid provided to the motor is equal to a second predetermined set point. The controller automatically adjusts the first predetermined set point to a setting for a make-up torque, wherein a torque limit is set at a level for proper make-up during a drill string make-up process, or to a setting for the operating torque limit during a boring process. Additionally, the controller automatically adjusts the second predetermined set point to be a predetermined amount higher than the first predetermined set point.

In yet another aspect, the disclosure provides a drilling machine having a rotary drive for applying torque to a drill string and a system for controlling the torque. The system includes a variable displacement hydraulic pump that provides hydraulic fluid to a motor at a variable flow rate. The system further includes a controller having an input provided by a pressure sensor configured to read a hydraulic pressure of the fluid provided to the motor. The controller is configured to provide a current signal to the hydraulic pump to de-stroke the pump when a pressure of the hydraulic fluid provided to the motor is equal to a first predetermined set point. The first predetermined set point is adjustable. The system further includes a cross-port relief that allows hydraulic fluid to bypass the motor when a pressure of the hydraulic fluid provided to the motor is equal to a second predetermined set point. The controller automatically adjusts the first predetermined set point to a setting for a make-up torque, wherein a torque limit is set at a level for proper make-up during a drill string make-up process, or to a setting for an operating torque limit during a boring process. The controller automatically adjusts the second predetermined set point to be a predetermined amount higher than the first predetermined set point.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
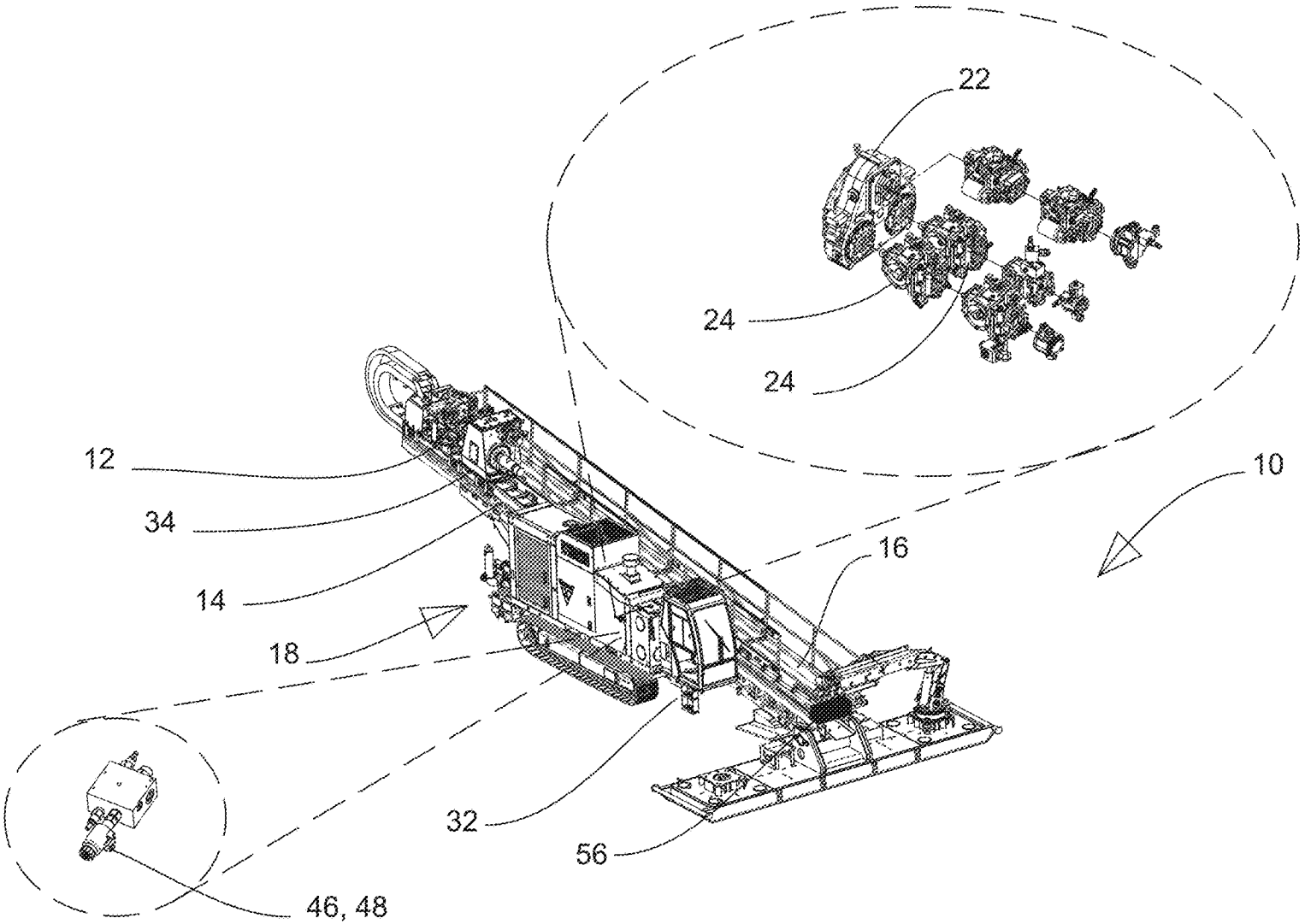
FIG. 1 is an isometric view of a Horizontal Directional Drilling (HDD) machine taken from the front and right side of the machine showing the hydraulic pump that is a component of the rotational drive unit.

The HDD machine 10 shown in FIG. 1 is configured for rotating a drill string during a boring process with rotational drive unit 12 mounted on carriage 14. The carriage is mounted to a rack frame 16 that includes a rack gear. Pinion gears are supported on the carriage and connected to thrust motors that rotate the pinion gears to move carriage along the rack gear and frame.

Figure 3:
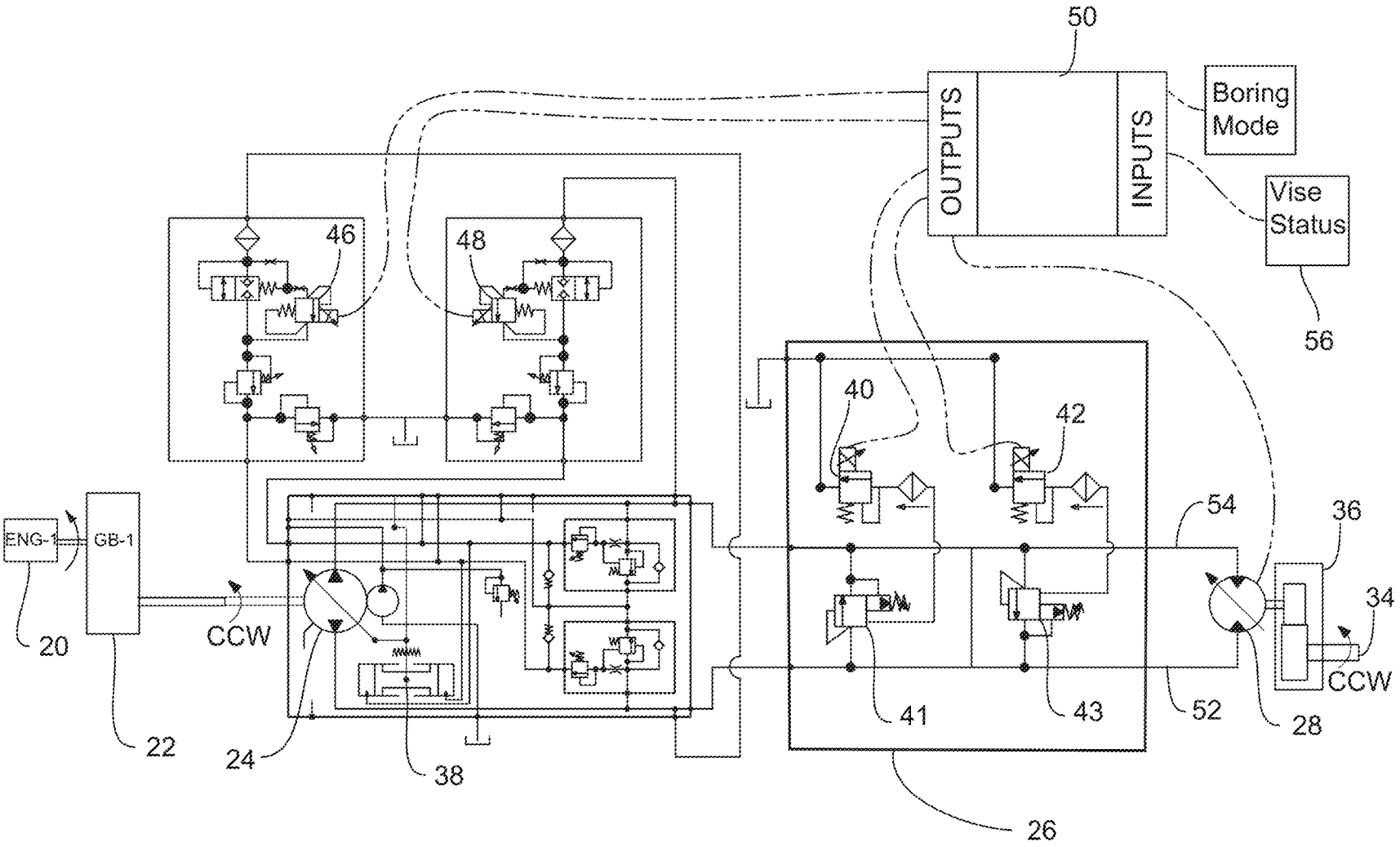
FIG. 3 is a simplified schematic showing the components of the hydraulic and control systems that are involved in the torque control system of the rotational drive unit of this invention.
Figure 4:
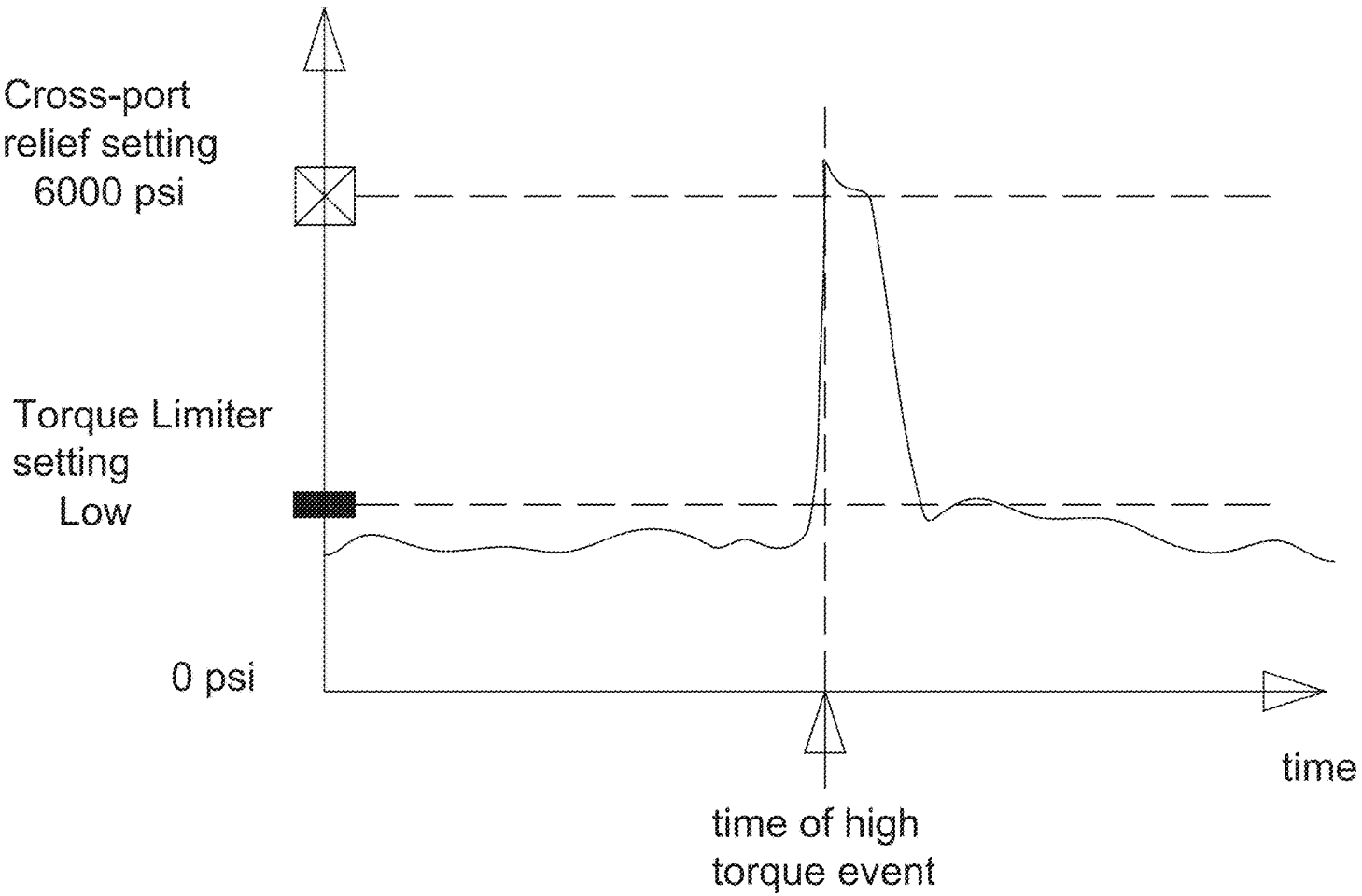
FIG. 4 ( PRIOR ART )
FIG. 4 is a graphical representation of system performance with a system of the prior art operated with the rotational drive unit in a mode having larger motor system displacement.

The HDD machine 10 includes a power unit 18 that typically includes a diesel engine 20 (see FIG. 3). Gearbox 22 is mounted to the engine 20, and rotation pump 24 is mounted to the gearbox, where it is powered by the diesel engine 20.

Figure 2:
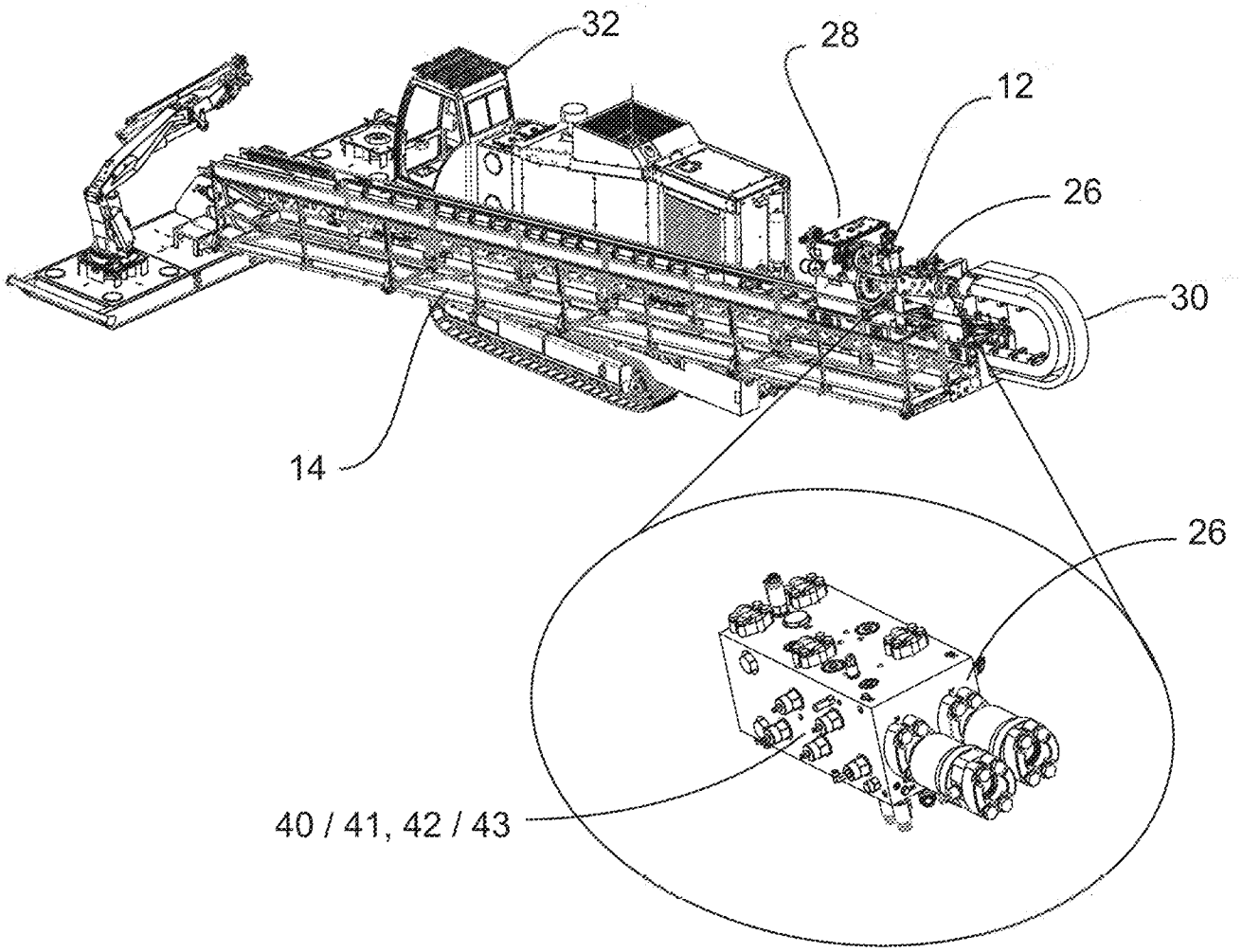
FIG. 2 is an isometric view of a Horizontal Directional Drilling (HDD) machine taken from the rear and left side showing the hydraulic motor and the cross-port relief manifold.

In FIG. 2 the left side of the HDD machine is shown where the rotational drive unit 12 and the carriage 14 are shown from the side opposite that of FIG. 1. A cross-port relief manifold 26 is mounted on the carriage in a position adjacent to the rotation motor 28 that is a component of the rotational drive unit 12.

Cable and hose carrier 30 support hydraulic hoses and control cables that span from the carriage 14 to the control station 32 where a control system is located, with operator controls and an operator display. The hydraulic hoses extend between the pump 24 in the housing of the power unit 18, and the rotation motor 28 on the carriage 14 to provide fluid communication therebetween, as well as with the associated valving described further below. As shown in FIGS. 1 and 2, there is a significant distance between the pump 24 and the rotation motor 28.

FIG. 3 illustrates the hydraulic and control system for the rotational drive unit. The rotation motor 28 is illustrated as being mounted to a rotation gearbox 36, having a gearset that transfers torque to drive spindle 34, to which the drill string will be connected. Motor 28 is illustrated as a variable displacement motor. This is intended to illustrate a motor system that could include a plurality of fixed displacement motors mounted to the gearbox along with valving to allow the overall system to operate with variable displacement, where a variable amount of oil is displaced when the spindle rotates through one revolution. This is typical of HDD machines where the drive spindle, to which the drill string is connected, is powered with a hydraulic system. The typical machines have various modes in order to meet the requirement to provide a wide range of operating speeds and torque control.

When the rotational drive system is in a low displacement mode, the maximum speed will be higher compared to a high displacement mode. When in the low displacement mode, the torque generated at the drive spindle by a certain level of pressure of the hydraulic oil will be lower than the torque generated when in a high displacement mode. The displacement mode will influence the relationship between hydraulic pressure and torque at the drive spindle. As an example, an HDD machine manufactured by Vermeer Corporation, a D220×300, has a rotational drive unit having a Low, Medium and High boring mode. With this machine, with a system pressure of 3000 psi, the maximum torque at the drive spindle is:

- 16,500 ft-lbs in Low boring mode, the mode having the highest displacement;
- 13,500 ft-lbs in Medium boring mode; and
- 7,700 ft-lbs in High boring mode, the mode having the lowest displacement.

FIG. 3 illustrates controller 50 operatively connected to the motor 28. This is intended to represent that the controller can affect the mode of the rotational drive system, to control the mode of the rotational drive unit. As noted previously, this control could be through changes to valves that affected oil flow paths through a plurality of motors, or control of the displacement of a variable displacement motor.

One of ordinary skill in the art will appreciate that many of the various electrical and mechanical parts discussed herein can be combined together or further separated apart. The controller 50 may include one or more electronic processors and one or more memory devices. The controller 50 may be communicably connected to one or more sensors or other inputs, such as described herein. The electronic processor may be implemented as a programmable microprocessor, an application specific integrated circuit (ASIC), one or more field programmable gate arrays (FPGA), a group of processing components, or with other suitable electronic processing components. The memory device (for example, a non-transitory, computer-readable medium) includes one or more devices (for example, RAM, ROM, flash memory, hard disk storage, etc.) for storing data and/or computer code for completing the or facilitating the various processes, methods, layers, and/or modules described herein. The memory device may include database components, object code components, script components, or other types of code and information for supporting the various activities and information structure described in the present application. According to one example, the memory device is communicably connected to the electronic processor and may include computer code for executing one or more processes described herein. The controller 50 may further include an input-output ("I/O") module. The I/O module may be configured to interface directly with one or more devices, such as a power supply, sensors, displays, etc. In one embodiment, the I/O module may utilize general purpose I/O (GPIO) ports, analog inputs/outputs, digital inputs/outputs, and the like.

The controller 50 is also operatively connected to proportional relief valves 40 and 42, which are located in the cross-port relief manifold 26. These relief valves are positioned in vent lines (fluid passages) that allow oil to flow from the vent port, of ventable, pilot-operated, balanced piston relief valves 41 and 43 (also located in the cross-port relief manifold 26). Valves 40 and 41 work together, and valves 42 and 43 work together, to serve as the cross-port relief valves, to tank. The relief valves 40, 42 allow control of vent pressure, and pressure in this vent port will control the piston relief valves 41 and 43 to open at a pressure below the opening pressure set by a manual adjustment. With this control, the system can vary the pressure at which the relief valves 41 and 43 open to allow oil to cross from the motor's inlet port to the motor's outlet port. Pump 24 can be controlled to direct oil flow through conduit 52 to rotate motor 28 in a forward direction or it can direct oil flow through conduit 54 to rotate motor 28 in the reverse direction. The forward direction is the direction in which the threaded connections of the drill rods in the drill string are tightened, while the reverse direction is the direction in which these threaded connections are loosened. When oil is directed into conduit 52, relief valve 41 acts as the cross-port relief, allowing oil to flow from conduit 52, to conduit 54 without passing through the motor 28. Similarly, when oil is directed into conduit 54, relief valve 43 acts as the cross-port relief, allowing oil to flow from conduit 54 to conduit 52 without passing through the motor 28. When this occurs, the oil is able to bypass the motor 28, to limit the maximum torque generated by the motor 28. This is a reactive control, the relief valves 41 and 43 open and close very quickly, reacting to variations in the load on the motor 28.

The controller 50 is also operatively connected to the proportional relief valves 46 and 48. These valves function as pressure limiters by opening when the pressure generated by the hydraulic motor 28 is greater than a desired pressure. The valves 46, 48 each work by having the cumulative force of pump pressure acting on a reaction area plus a proportional solenoid force, acting on one side of the valve, balanced against a spring force. The valve will open when the cumulative force is able to overcome the spring force. The proportional solenoid force can be changed by varying the electrical signal sent from the controller 50. This is often-times a pulse width modulated signal. A higher solenoid force will result in the valve opening when the pump pressure is lower. When the valve opens, it directs oil to displacement control 38 of the pump 24, to reduce the pump displacement. There are two valves: valve 46 that limits pressure generated by the pump 24 when pumping oil into conduit 52, that results in the motor 28 rotating the drill string in a forward direction, and valve 48 that limits pressure generated by the pump 24 when pumping oil into conduit 54, that results in the motor 28 rotating the drill sting in a reverse direction. This is a proactive control, the relief valves 46, 48 open, and direct oil to the pump's displacement control. The response time for this system is significant, it does not react quickly, but it is intended to be capable of controlling the pressure over an extended period of time.

Figure 8:
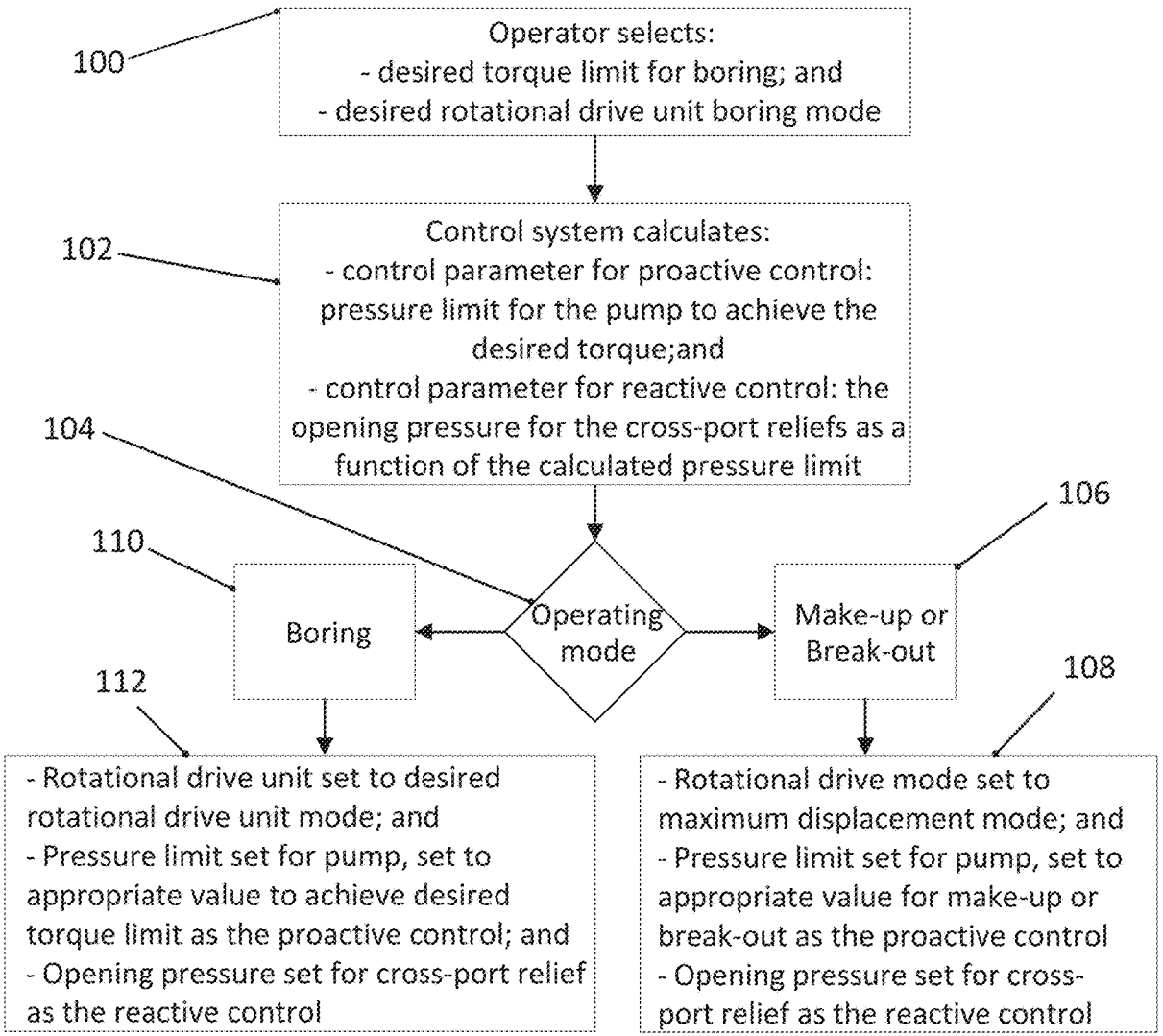
FIG. 8 is a logic flow chart illustrating logic the controller utilizes in determining the appropriate pressure limit for the hydraulic motor and the appropriate opening pressure for the cross-port relief

FIG. 8 illustrates the expected method of operation which starts with an operator making a selection of a desired torque limit and a desired rotational drive unit boring mode at step 100. The operator input of the boring mode/torque limit is input to the controller 50. In response, the controller 50 calculates:

1) a control parameter for the proactive control, by calculating the appropriate pressure limit for the pump 24 appropriate to achieve the requested torque limit; and 2) a control parameter for the reactive control, by calculating the appropriate pressure setting for the relief valve 40, 42 that will affect the opening pressure of the cross-port relief valves 41, 43. The desired opening pressure of the relief valves 41, 43 is a function of the pressure limit set by the requested torque limit.

These calculations occur in step 102 shown in FIG. 8.

The operator controls, including the boring mode setting, can include, for example, levers, switches, dials, buttons, or any other appropriate controls, whether now existing or later developed. In some embodiments, at least one of the operator controls is not in direct physical communication with the controller 50, and instead communicates with the controller 50 wirelessly, such as through one or more of near-field (e.g. Bluetooth, Bluetooth Low Energy, LoRA, Near Field Communication ("NFC"), Wi-Fi, Wi-Max, etc.), radio (e.g. RF), or cellular communication technology (e.g. 3G, 4G, 5G, LTE, etc.).

At step 104 the control system monitors the operating mode of the HDD machine. A status of a vise or wrench 56 provided on the HDD machine (see FIG. 1) to selectively grip segments of the drill string is provided as an input to the controller 50. If the vise or wrench 56 of the machine is securing the drill string, then the control system will recognize that the machine is in a make-up or break-out mode as shown in step 106 of FIG. 8. These are the modes where an individual drill rod is being either added-to or removed from the drill string. In these modes the controller will send signals at step 108:

1) to the rotational motor system setting that system to the maximum displacement mode, to maximize the torque capability of the rotational drive unit.

2) at approximately the same time the control system will set the proactive control parameter, the pressure limit for the pump 24, to an appropriate level to control torque. For the forward rotation direction, the system will adjust the proportional signal sent to valve 48 to achieve a pressure required for a torque-setting appropriate for the make-up torque for the drill rod. For the reverse rotation direction, the system will adjust the proportional signal sent to valve 46 to achieve a pressure required for a torque-setting appropriate for the break-out torque for the drill rod. In a preferred embodiment the system will adjust the system for maximum system pressure for reverse direction.

3) The control system will also adjust the electrical signal sent to the relief valves 40 and 42 to adjust the back pressure applied in the vent port of the cross-port relief valves so that the opening pressure of relief valves 41 and 43 is higher than the pressure limit set by the associated pressure limiting valve. The opening pressure of the relief valves 41, 43 can be set to at least 1 psi more than the pressure limit set by the associated pressure limiting valve. In some embodiments, the opening pressure of the relief valves 41, 43 can be set to at least 50 psi more than the pressure limit set by the associated pressure limiting valve. In the illustrated embodiment and in performance testing, it has been found that a 300 psi to a 500 psi increase yields good results. The signal sent to valve 40 will be related to (i.e., a function of) the signal sent to valve 48 and the signal sent to valve 42 will be related to (i.e., a function of) the signal sent to valve 46.

If, at step 104, the system detects that the vise or wrench 56 of the machine is not securing the drill string, then the control system will recognize that the machine is in a boring mode as shown in step 110 of FIG. 8. In this mode the controller will send signals at step 112:

1) to the rotational motor system setting that system to the boring mode selected by the operator.
2) At approximately the same time the control system will set the proactive control parameter, the pressure limit for the pump 24, to an appropriate level to control torque. For the forward rotation direction, the system will adjust the proportional signal sent to valve 48 to achieve a pressure required for a torque-setting appropriate for the torque limit selected by the operator. For the reverse rotation direction, the system will adjust the proportional signal sent to valve 46 to achieve a pressure required for a torque-setting appropriate for reverse rotation in a boring mode. This is typically lower than the make-up torque, to prevent unintended separation of a drill rod joint in the drill string.
3) The control system will also adjust the electrical signal sent to the relief valves 40 and 42 to adjust the back pressure applied in the vent port of the cross-port relief valves so that the opening pressure of relief valves 41 and 43 is higher (e.g., 300 psi to 500 psi) than the pressure limit set by the associated pressure limiting valve. The signal sent to valve 40 will be related to (i.e., a function of) the signal sent to valve 48 and the signal sent to valve 42 will be related to (i.e., a function of) the signal sent to valve 46.

Figure 6:
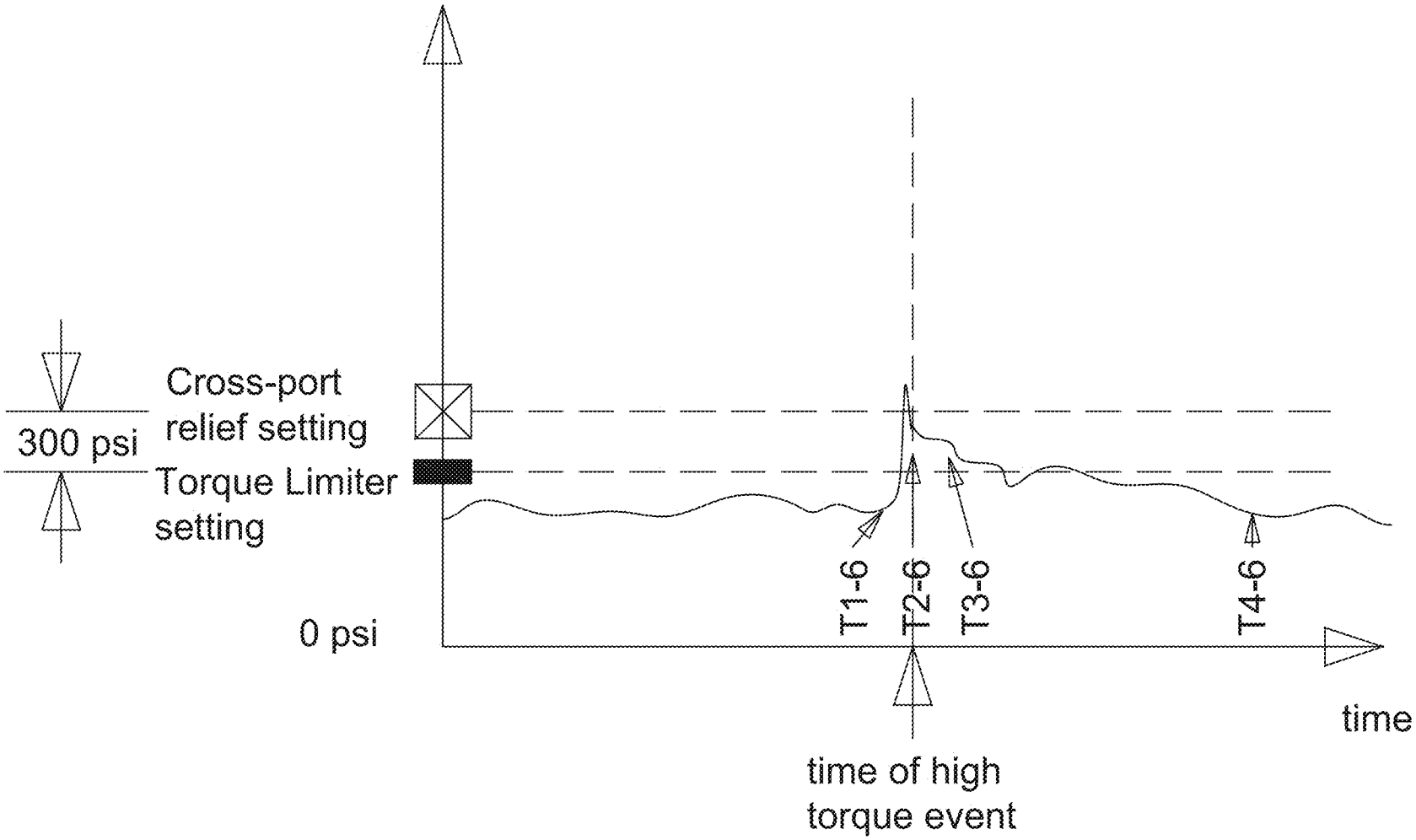
FIG. 6 is a graphical representation of system performance with a system of the invention operated with the rotational drive unit in a mode having larger motor system displacement.
Figure 7:
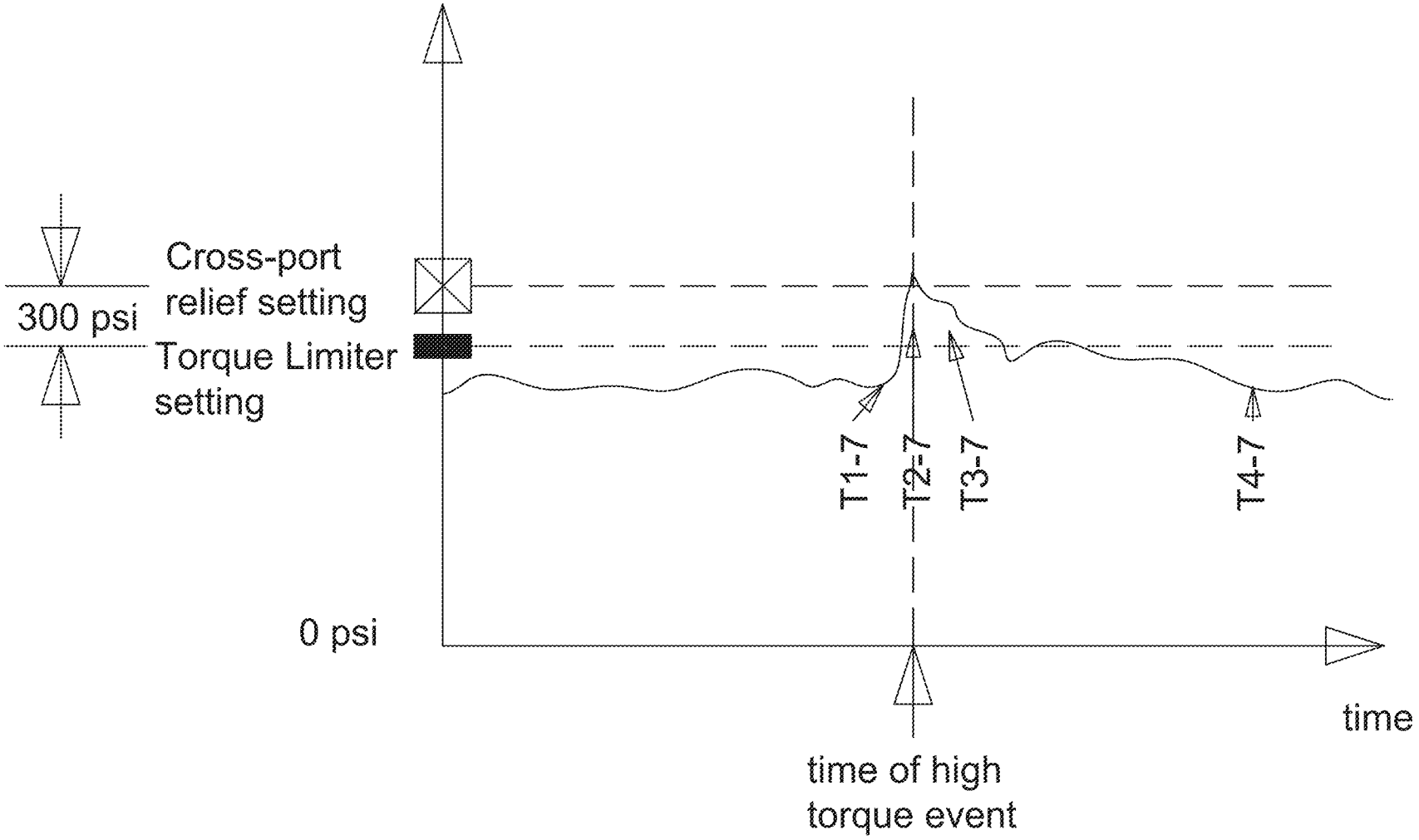
FIG. 7 is a graphical representation of system performance with a system of the invention operated with the rotational drive unit in a mode having smaller motor system displacement.

FIGS. 6 and 7 illustrate the expected system performance where the reactive control can be adjusted in coordination with the proactive control. FIG. 6 illustrates the expected performance with the system operating in a rotational drive or boring mode wherein the required system pressure is relatively low, such as 1000 to 2000 pounds per square inch. Operation in this mode will maximize the expected life and the operating efficiency of the system. Since the cross-port relief setting can be automatically adjusted to match the torque limiter setting, the unintended increase in torque resulting from a high-torque event is minimized.

An event that results in a fast increase in torque is illustrated in the performance curve of FIG. 6. During the time before time T1-6 the system is operating at a pressure below the Torque Limiter Setting, the pressure that will result in the system generating the maximum torque selected by the operator. At a time T1-6 the machine encounters a ground condition that results in an increase in torque and resulting pressure. At time T2-6 the cross-port relief valves 40/41, 42/43 are open to limit the pressure rise. At time T3-6 a proportional relief valve 46 or 48 is open directing oil to the pump's displacement control to control flow to a rate that results in the flow generating the maximum torque as set by the torque limiter setting selected by the operator. The system could continue operating at this, the maximum desired torque for some time. At time T4-6 the system is shown with the pressure dropping down to a pressure less than the pressure that results in the maximum set torque.

Figure 5:
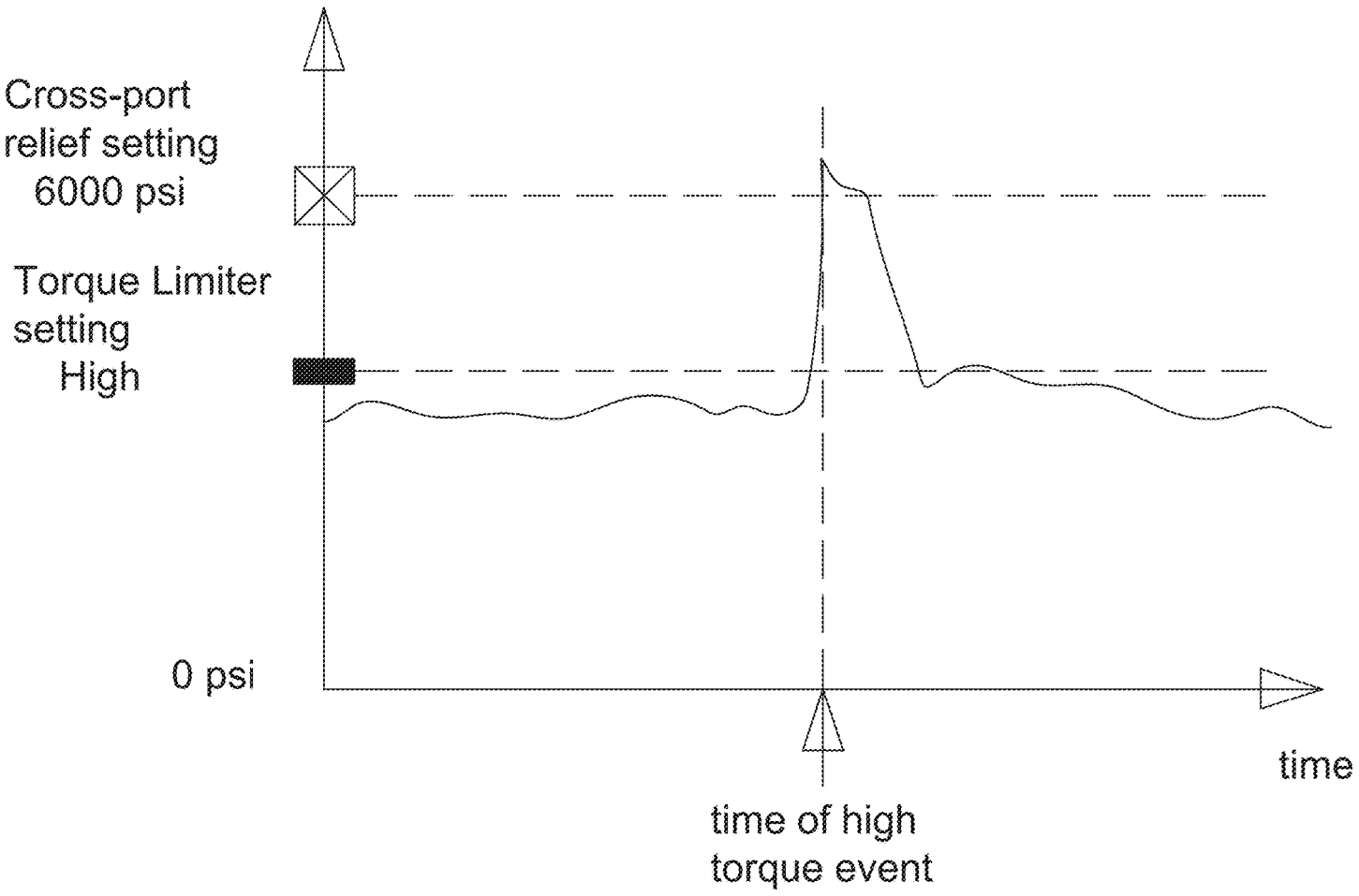
FIG. 5 ( PRIOR ART )
FIG. 5 is a graphical representation of system performance with a system of the prior art operated with the rotational drive unit in a mode having smaller motor system displacement.

FIG. 7 illustrates the expected performance with the system operating in a rotational drive or boring mode wherein the required system pressure is relatively high, such as 3000 to 4000 pounds per square inch, higher than that illustrated in FIG. 6. This mode would not be the preferred mode of operation, but even in this mode the increase in torque resulting from a high-torque event will be lower than torque increase shown in the prior art FIG. 5. At time T1-7 the system pressure starts to increase from an operating pressure slightly lower than the pressure that corresponds to the Torque Limiter Setting. At time T2-7 the cross-port relief valves 40/41, 42/43 are open, limiting the pressure increase to 300 pounds per square inch above the pressure that corresponds to the Torque Limiter Setting. At time T3-7 the cross-port relief valve will be closed, and a proportional relief valve 46 or 48 is open directing oil to the pump's displacement control to control flow to a rate that results in the flow generating the maximum torque as set by the torque limiter setting selected by the operator. By time T4-7 the required pressure has dropped to less than the maximum, and the operating pressure has dropped back to the normal operating pressure.

Figure 9:
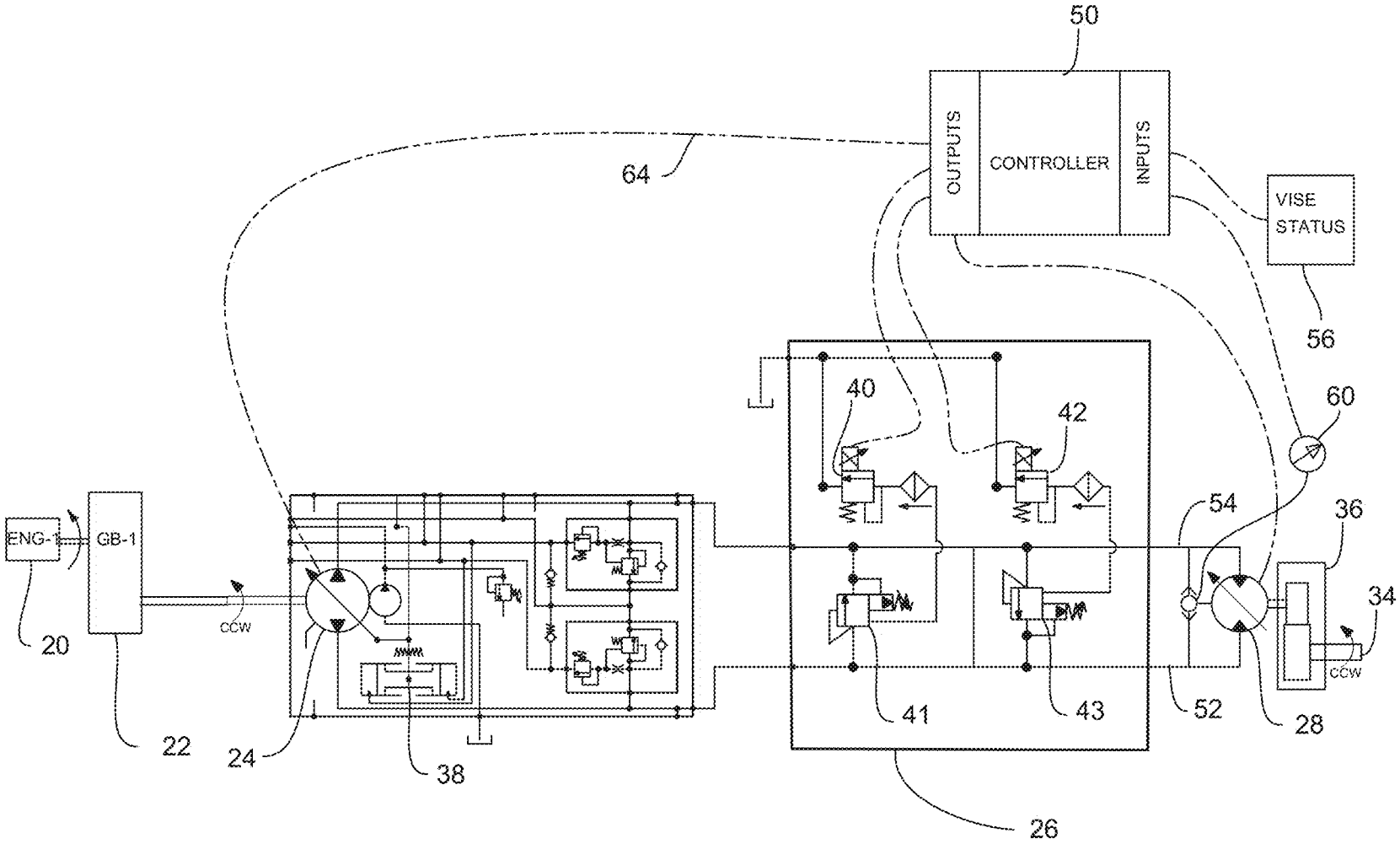
FIG. 9 is a simplified schematic showing the components of the hydraulic and control systems that are involved in an alternative torque control system of the rotational drive unit of this invention.

FIG. 9 illustrates an alternative torque control system that is similar to the system of FIG. 3 as described above, but instead of the torque limiter valve arrangement as the proactive control, the controller 50 instead utilizes a pressure-based control algorithm and adjusts the current to the pump 24 to function as the proactive control. Like parts have been given like reference numerals. As shown in FIG. 9, a pressure sensor 60 is configured to detect pressure at the hydraulic motor 28 to provide feedback data to a closed-loop control algorithm, run by the controller 50, and that controls the electrical current to the pump 24. The control algorithm uses a defined or predetermined maximum pressure, that is proportional to a desired maximum torque for the given operating condition (e.g., make-up, break-out, or boring), and if the measured pressure exceeds that predetermined maximum pressure, then the controller 50 reduces the current provided to the pump 24, effectively de-stroking the pump 24, to control this maximum pressure. FIG. 9 illustrates the current signal output from the controller 50 to the pump 24 schematically as line 64. This is an alternative system for providing proactive control of the torque, but its response time is also slow enough that the additional reactive control is needed.

The system illustrated in FIG. 9, therefore includes the same reactive control described above, including the valves 40 and 41 working together, and valves 42 and 43 working together, to serve as the cross-port relief valves. The control system will automatically adjust the electrical signal sent to the relief valves 40 and 42 to adjust the back pressure applied in the vent port of the cross-port relief valves so that the opening pressure of relief valves 41 and 43 is higher than the predetermined pressure limit set by the pressure-based control algorithm for the operating condition (e.g., make-up, break-out, or boring). The opening pressure of the relief valves 41, 43 can be set to at least 1 psi more than the predetermined pressure limit used by the pressure-based control algorithm (i.e., the proactive control setting). In some embodiments, the opening pressure of the relief valves 41, 43 can be set to at least 50 psi more than the predetermined pressure limit used by the pressure-based control algorithm. In the illustrated embodiment, it has been found that a 300 psi to a 500 psi increase yields good results. The signal sent to valve 40 will be related to (i.e., a function of) the predetermined pressure limit used by the pressure-based control algorithm, and the signal sent to valve 42 will be related to (i.e., a function of) the predetermined pressure limit used by the pressure-based control algorithm.

Various features are set forth in the following claims.

What is claimed is:

1. A drilling machine having a rotary drive for applying torque to a drill string and a system for controlling the torque, the system comprising:

a controller having an operator input that allows an operator to specify an operating torque limit;

a variable displacement hydraulic pump that provides hydraulic fluid to a motor at a variable flow rate;

a torque limiter valve that provides hydraulic fluid to de-stroke the pump when a pressure of the hydraulic fluid provided to the motor is equal to a first predetermined set point, wherein the first predetermined set point is adjustable;

a cross-port relief that allows hydraulic fluid to bypass the motor when a pressure of the hydraulic fluid provided to the motor is equal to a second predetermined set point;

wherein the controller automatically adjusts the first predetermined set point to a setting for a make-up torque, wherein a torque limit is set at a level for proper make-up during a drill string make-up process, or to a setting for the operating torque limit during a boring process; and wherein the controller automatically adjusts the second predetermined set point to be a predetermined amount higher than the first predetermined set point.

2. The drilling machine of claim 1, wherein the second predetermined set point is 300 to 500 psi higher than the first predetermined set point.

3. The drilling machine of claim 1, wherein the controller further comprises a vise clamp input indicating that a vise of the drilling machine is clamping the drill string, and wherein the controller automatically adjusts the first predetermined set point to the setting for a make-up torque when the controller receives the vise clamp input.

4. The drilling machine of claim 3, wherein the controller automatically adjusts the first predetermined set point to a setting for the operating torque limit when the vise clamp input is not received at the controller.

5. The drilling machine of claim 3, wherein the controller is further operable to selectively automatically adjust the first predetermined set point to a setting for a break-out torque when the controller receives the vise clamp input.

6. The drilling machine of claim 1, wherein the torque limiter valve is located adjacent the variable displacement hydraulic pump in a power unit housing of the drilling machine, and wherein the cross-port relief is located adjacent the motor on a movable carriage of the drilling machine.

7. The drilling machine of claim 6, wherein the torque limiter valve and the cross-port relief are in fluid communication with one another via hydraulic fluid hoses.

8. A method of controlling a horizontal directional drill having a rotary drive system for applying torque to a drill string, the rotary drive system including a variable displacement pump providing pressurized fluid to a motor that generates the torque, a displacement control that adjusts motor displacement to limit flow to maintain a controlled pressure, a torque limiter valve that opens at a torque limit pressure to provide pressurized fluid to the displacement control to allow the system to limit torque when a system pressure is equal to a pressure that will generate a desired maximum torque, and cross-port relief valves that open at a cross-port relief pressure to limit pressure applied across a motor inlet and a motor outlet, the method comprising:

adjusting the torque limiter pressure to set the maximum torque applied to the drill string based on operating parameters of the horizontal direction drill; and adjusting the cross-port relief pressure to be higher than the torque limiter pressure each time that the torque limiter pressure is adjusted.

9. The method of claim 8, wherein adjusting the cross-port relief pressure to be higher than the torque limiter pressure includes adjusting the cross-port relief pressure to be 300 to 500 psi higher than the torque limiter pressure.

10. The method of claim 8, wherein the pressure limiter valve and the cross-port relief valves are controlled electronically and the horizontal directional drill further comprises a control system with an operator input and with an input indicating the status of a vise configured to clamp the drill string, the method further comprising:

automatically adjusting the torque limiter pressure when the vise clamps the drill string to set a make-up torque, and in response also adjusting the cross-port relief pressure to be higher than the torque limiter pressure set for the make-up torque; and automatically adjusting the torque limiter pressure to a pressure that corresponds to an operator selected maximum torque when the vise is not clamping the drill string, and in response also adjusting the cross-port relief pressure to be higher than the torque limiter pressure corresponding to the operator selected maximum torque.

11. The method of claim 10, wherein adjusting the cross-port relief pressure to be higher than the torque limiter pressure set for the make-up torque includes adjusting the cross-port relief pressure to be 300 to 500 psi higher than the torque limiter pressure; and wherein adjusting the cross-port relief pressure to be higher than the torque limiter pressure corresponding to the operator selected maximum torque includes adjusting the cross-port relief pressure to be 300 to 500 psi higher than the torque limiter pressure.

12. The method of claim 8, wherein the pressure limiter valve and the cross-port relief valves are controlled electronically and the horizontal directional drill further comprises a control system with an operator input and with an input indicating the status of a vise configured to clamp the drill string, the method further comprising:

automatically adjusting the torque limiter pressure when the vise clamps the drill string to set a break-out torque, and in response also adjusting the cross-port relief pressure to be higher than the torque limiter pressure set for the break-out torque; and automatically adjusting the torque limiter pressure to a pressure that corresponds to an operator selected maximum torque when the vise is not clamping the drill string, and in response also adjusting the cross-port relief pressure to be higher than the torque limiter pressure corresponding to the operator selected maximum torque.

13. The method of claim 12, wherein adjusting the cross-port relief pressure to be higher than the torque limiter pressure set for the break-out torque includes adjusting the cross-port relief pressure to be 300 to 500 psi higher than the torque limiter pressure; and wherein adjusting the cross-port relief pressure to be higher than the torque limiter pressure corresponding to the operator selected maximum torque includes adjusting the cross-port relief pressure to be 300 to 500 psi higher than the torque limiter pressure.

14. The method of claim 8, wherein the horizontal directional drill has a variable displacement motor having a plurality of operating modes, the method comprising automatically adjusting the torque limiter pressure as a function of the operating mode of the variable displacement motor, and in response automatically adjusting the cross-port relief pressure.

15. A drilling machine having a rotary drive for applying torque to a drill string and a system for controlling the torque, the system comprising:

a variable displacement hydraulic pump that provides hydraulic fluid to a motor at a variable flow rate;

a controller having an input provided by a pressure sensor configured to read a hydraulic pressure of the fluid provided to the motor, the controller configured to provide a current signal to the hydraulic pump to de-stroke the pump when a pressure of the hydraulic fluid provided to the motor is equal to a first predetermined set point, wherein the first predetermined set point is adjustable;

a cross-port relief that allows hydraulic fluid to bypass the motor when a pressure of the hydraulic fluid provided to the motor is equal to a second predetermined set point;

wherein the controller automatically adjusts the first predetermined set point to a setting for a make-up torque, wherein a torque limit is set at a level for proper make-up during a drill string make-up process, or to a setting for an operating torque limit during a boring process; and wherein the controller automatically adjusts the second predetermined set point to be a predetermined amount higher than the first predetermined set point.

16. The drilling machine of claim 15, wherein the second predetermined set point is 300 to 500 psi higher than the first predetermined set point.

17. The drilling machine of claim 15, wherein the controller further comprises a vise clamp input indicating that a vise of the drilling machine is clamping the drill string, and wherein the controller automatically adjusts the first predetermined set point to the setting for a make-up torque when the controller receives the vise clamp input.

18. The drilling machine of claim 17, wherein the controller automatically adjusts the first predetermined set point to a setting for the operating torque limit when the vise clamp input is not received at the controller.

19. The drilling machine of claim 17, wherein the controller is further operable to selectively automatically adjust the first predetermined set point to a setting for a break-out torque when the controller receives the vise clamp input.

* * * * *